US006169874B1

(12) United States Patent
Quesnel et al.

(10) Patent No.: US 6,169,874 B1
(45) Date of Patent: Jan. 2, 2001

(54) ANTI-WRINKLE FUSER BAFFLE

(75) Inventors: Lisbeth S. Quesnel, Pittsford; David P. Van Bortel, Macedon, both of NY (US)

(73) Assignee: Xerox Corporation, Stamford, CT (US)

( * ) Notice: Under 35 U.S.C. 154(b), the term of this patent shall be extended for 0 days.

(21) Appl. No.: 09/004,461

(22) Filed: Jan. 8, 1998

(51) Int. Cl.[7] ..... G03G 15/00
(52) U.S. Cl. ..... 399/400; 399/397
(58) Field of Search ..... 399/397, 400

(56) References Cited

U.S. PATENT DOCUMENTS

| | | | |
|---|---|---|---|
| 4,843,214 | 6/1989 | Higashi et al. | 219/216 |
| 4,876,576 | 10/1989 | Itaya et al. | 355/285 |
| 5,063,415 | * 11/1991 | Ariyama | 399/397 |
| 5,515,151 | 5/1996 | Velazquez | 355/308 |
| 5,519,477 | 5/1996 | Bell et al. | 355/282 |
| 5,689,788 | 11/1997 | Moser | 399/328 |
| 5,689,789 | 11/1997 | Moser | 399/331 |

FOREIGN PATENT DOCUMENTS

| | | |
|---|---|---|
| 60-050568 | 3/1985 | (JP) . |
| 61-067068 | 4/1986 | (JP) . |
| 63-271381 | * 11 1988 | (JP) . |
| 1-105279 | * 4/1989 | (JP) . |
| 5-78001 | * 3/1993 | (JP) . |
| 5-341600 | * 12 1993 | (JP) . |
| 9-22207 | * 1/1997 | (JP) . |
| 9-237002 | * 9/1997 | (JP) . |

* cited by examiner

*Primary Examiner*—Quana M. Grainger
(74) *Attorney, Agent, or Firm*—Kevin R. Kepner; William F. Eipert

(57) ABSTRACT

A fuser baffle which helps to minimize or eliminate sheet wrinkle by a fuser. A small "saddle" is added to the center section of the inlet to the fuser on the baffle surface which last contacts and controls the sheet before entry into the fuser nip. The saddle removes most of the corrugation along approximately 90 to 95% of the centermost portion of the sheet. Any remaining corrugation at the inboard and outboard ends is removed by the fuser flare. The baffle is applicable to any fusing device which uses localized pressure to fix an image to a sheet.

8 Claims, 4 Drawing Sheets

ANTI-WRINKLE FUSER BAFFLE

This invention relates generally to a sheet feed for a fuser device, and more particularly concerns a sheet path configuration to minimize sheet wrinkle during the fusing step.

In a typical electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in the irradiated areas. This records an electrostatic latent image on the photoconductive member corresponding to the informational areas contained within the original document. After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet.

Fusers tends to wrinkle paper lengthwise, with longer process length sheets experiencing the worst wrinkle. The basic cause is non-flat paper at fuser entry. To counter wrinkle, fuser flare is standard practice; however, as machine cycle times decrease in the duplex mode, and as scanners decrease in width thus forcing 17 inch sheets to be fed short edge feed, fuser flare alone is not able to "iron out" all sheets. Increasing the flare profile introduces a new failure mode.

It is desirable to have a baffle which successfully removes most of the corrugation in the sheet before entry to the fuser. Remaining small amounts of corrugation, at the inboard and outboard ends, are removed by the action of the fuser flare profile The following disclosures may relate to various aspects of the present invention.

U.S. Pat. No. 5,689,789

Patentee: Moser

Issue Date: Nov. 18, 1997

U.S. Pat. No. 5,689,788

Patentee: Moser

Issue Date: Nov. 18, 1997

Some portions of the foregoing disclosures may be briefly summarized as follows:

U.S. Pat. No. 5,689,789 discloses a heat and pressure roll fuser for fixing powder images to various substrates. Each of the rolls has a deformable outer layer. One of the rollers is crowned such that its center has a larger diameter than its ends. The other roller has a uniform diameter along its entire length. The difference in the center diameter and the end diameters is such that the fuser produces a nonuniform nip and a uniform nip velocity.

U.S. Pat. No. 5,689,788 discloses a heat and pressure roll fuser for fixing powder images to various substrates. Each of the rolls has a deformable outer layer. One of the rollers is crowned such that its center has a larger diameter than its ends. The other roller has a uniform diameter along its entire length. The difference in the center diameter and the end diameters is such that the fuser produces a substantially uniform nip and a uniform nip velocity. A flared pressure roll is provided for controlling the speed of substrate edges to compensate for waviness along the substrate edges, such waviness being due to moisture picked up by the substrates while being stored prior to being used for duplex imaging.

In accordance with one aspect of the present invention, there is provided a printing machine in which an image on a sheet is heat and pressure fused to the sheet, comprising a marking engine to place a toner image on a sheet, a pressure fusing device;

a drive for transporting the sheet having an unfused image thereon to said fusing device and a baffle located between said drive and said fusing device, said baffle having a protrusion formed therein to remove wrinkle from the sheet prior to fusing.

Pursuant to another aspect of the present invention, there is provided a printing machine in which an image on a sheet is pressure fused to the sheet, comprising a marking engine to place a toner image on a sheet, a pressure fusing device, a drive for transporting the sheet having an unfused image thereon to said fusing device and a baffle located between said drive and said fusing device, said baffle having a substantially V-shape formed therein to remove wrinkle from the sheet prior to fusing.

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
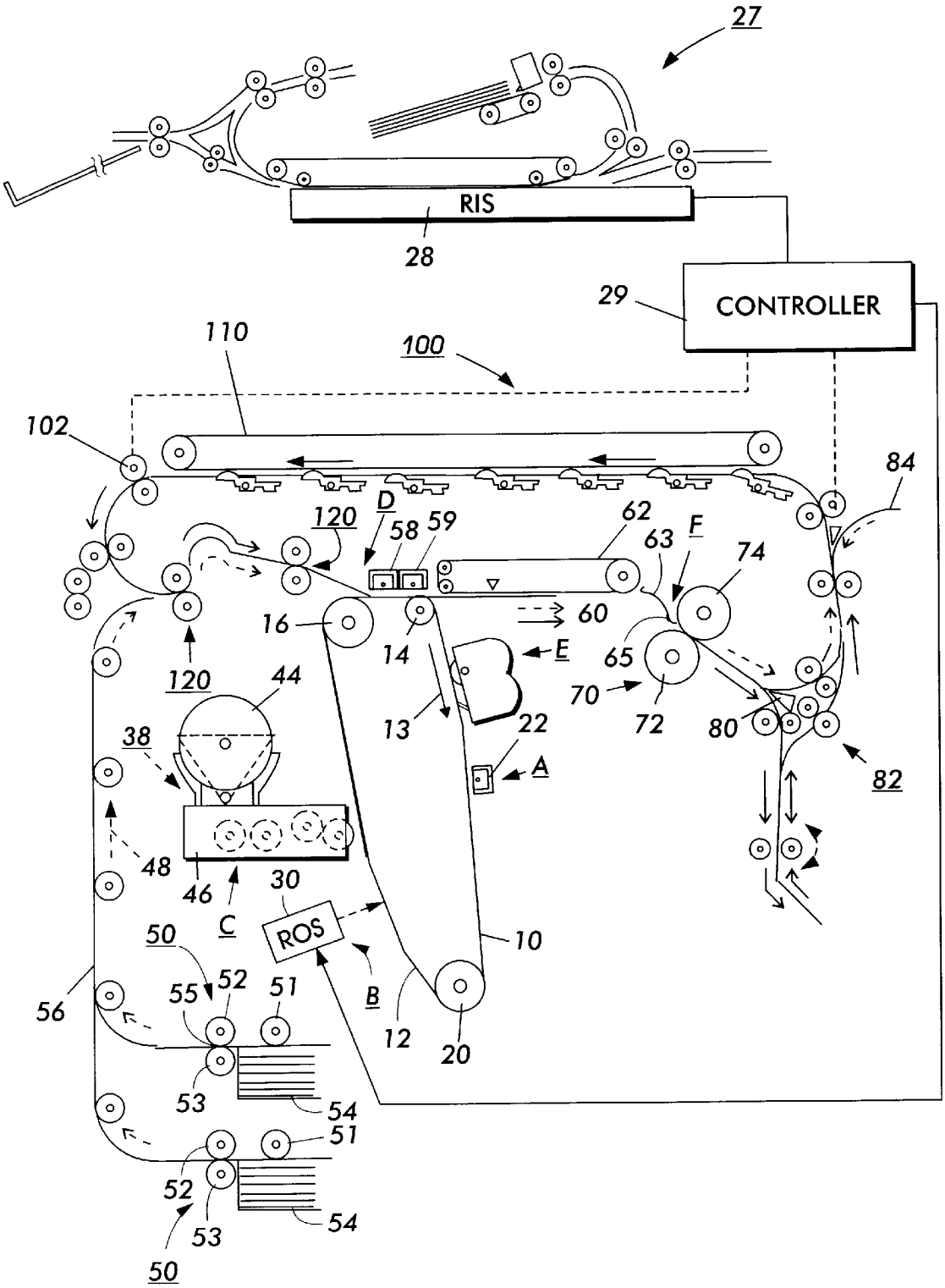
FIG. 1 is a schematic elevational view of a typical electrophotographic printing machine utilizing the anti-wrinkle fuser baffle described herein.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the anti-wrinkle device of the present invention may be employed in a wide variety of devices and is not specifically limited in its application to the particular embodiment depicted herein.

Referring to FIG. 1 of the drawings, an original document is positioned in a document handler 27 on a raster input scanner (RIS) indicated generally by reference numeral 28. The RIS contains document illumination lamps, optics, a mechanical scanning drive and a charge coupled device (CCD) array. The RIS captures the entire original document and converts it to a series of raster scan lines. This information is transmitted to an electronic subsystem (ESS) which controls a raster output scanner (ROS) described below.

FIG. 1 schematically illustrates an electrophotographic printing machine which generally employs a photoconductive belt 10. Preferably, the photoconductive belt 10 is made from a photoconductive material coated on a ground layer, which, in turn, is coated on an anti-curl backing layer. Belt 10 moves in the direction of arrow 13 to advance successive portions sequentially through the various processing stations disposed about the path of movement thereof. Belt 10 is entrained about stripping roller 14, tensioning roller 20 and drive roller 16. As roller 16 rotates, it advances belt 10 in the direction of arrow 13.

Initially, a portion of the photoconductive surface passes through charging station A. At charging station A, a corona generating device indicated generally by the reference numeral 22 charges the photoconductive belt 10 to a relatively high, substantially uniform potential.

At an exposure station, B, a controller or electronic subsystem (ESS), indicated generally by reference numeral 29, receives the image signals representing the desired output image and processes these signals to convert them to a continuous tone or greyscale rendition of the image which is transmitted to a modulated output generator, for example the raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks. The ROS will expose the photoconductive belt to record an electrostatic latent image thereon corresponding to the continuous tone image received from ESS 29. As an alternative, ROS 30 may employ a linear array of light emitting diodes (LEDs) arranged to illuminate the charged portion of photoconductive belt 10 on a raster-by-raster basis.

After the electrostatic latent image has been recorded on photoconductive surface 12, belt 10 advances the latent image to a development station, C, where toner, in the form of liquid or dry particles, is electrostatically attracted to the latent image using commonly known techniques. The latent image attracts toner particles from the carrier granules forming a toner powder image thereon. As successive electrostatic latent images are developed, toner particles are depleted from the developer material. A toner particle dispenser, indicated generally by the reference numeral 39, dispenses toner particles into developer housing 40 of developer unit 38.

With continued reference to FIG. 1, after the electrostatic latent image is developed, the toner powder image present on belt 10 advances to transfer station D. A print sheet 48 is advanced to the transfer station, D, by a sheet feeding apparatus, 50. Preferably, sheet feeding apparatus 50 includes a nudger roll 51 which feeds the uppermost sheet of stack 54 to nip 55 formed by feed roll 52 and retard roll 53. Feed roll 52 rotates to advance the sheet from stack 54 into vertical transport 56. Vertical transport 56 directs the advancing sheet 48 of support material into the registration transport 120 of the invention herein, described in detail below, past image transfer station D to receive an image from photoreceptor belt 10 in a timed sequence so that the toner powder image formed thereon contacts the advancing sheet 48 at transfer station D. Transfer station D includes a corona generating device 58 which sprays ions onto the back side of sheet 48. This attracts the toner powder image from photoconductive surface 12 to sheet 48. The sheet is then detacked from the photoreceptor by corona generating device 59 which sprays oppositely charged ions onto the back side of sheet 48 to assist in removing the sheet from the photoreceptor. After transfer, sheet 48 continues to move in the direction of arrow 60 by way of belt transport 62 which advances sheet 48 to the baffle 63 prior to fusing station F which includes fuser assembly 70.

Fusing station F includes a fuser assembly indicated generally by the reference numeral 70 which permanently affixes the transferred toner powder image to the copy sheet. Preferably, fuser assembly 70 includes a heated fuser roller 72 and a pressure roller 74 with the powder image on the copy sheet contacting fuser roller 72. The pressure roller is cammed against the fuser roller to provide the necessary pressure to fix the toner powder image to the copy sheet. The fuser roll is internally heated by a quartz lamp (not shown). Release agent, stored in a reservoir (not shown), is pumped to a metering roll (not shown). A trim blade (not shown) trims off the excess release agent. The release agent transfers to a donor roll (not shown) and then to the fuser roll 72.

The sheet then passes through fuser 70 where the image is permanently fixed or fused to the sheet. After passing through fuser 70, a gate 80 either allows the sheet to move directly via output 16 to a finisher or stacker, or deflects the sheet into the duplex path 100, specifically, first into single sheet inverter 82 here. That is, if the sheet is either a simplex sheet, or a completed duplex sheet having both side one and side two images formed thereon, the sheet will be conveyed via gate 80 directly to output 84. However, if the sheet is being duplexed and is then only printed with a side one image, the gate 80 will be positioned to deflect that sheet into the inverter 82 and into the duplex loop path 100, where that sheet will be inverted and then fed to acceleration nip 102 and belt transports 110, for recirculation back through transfer station D and fuser 70 for receiving and permanently fixing the side two image to the backside of that duplex sheet, before it exits via exit path 84.

After the print sheet is separated from photoconductive surface 12 of belt 10, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade to remove the nontransferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

The various machine functions are regulated by controller 29. The controller is preferably a programmable microprocessor which controls all of the machine functions hereinbefore described. The controller provides a comparison count of the copy sheets, the number of documents being recirculated, the number of copy sheets selected by the operator, time delays, jam corrections, etc. The control of all of the exemplary systems heretofore described may be accomplished by conventional control switch inputs from the printing machine consoles selected by the operator. Conventional sheet path sensors or switches may be utilized to keep track of the position of the document and the copy sheets.

Fuser wrinkle is a persistent paper handling problem in fuser assemblies. The stress case is lightweight, side two sheets in trayless duplex mode because sheets do not have enough time to reach an equilibrium condition with respect to moisture and stiffness before once again re-entering the fuser for side two fusing. As machine speed increases, and as sheet throughput is maximized by minimizing sheet travel and time within the duplex path, this problem will become evident in more machines of the future.

The airflow in the prefuser transport causes sheets to corrugate, with corrugation being inversely proportional to sheet stiffness. Upon entry to the fuser, the flare in the fuser profile is not enough to remove the corrugation. Flare, or conicity at the ends, adds a velocity component which minutely stretches the ends of the sheet outwards, while simultaneously moving the sheet through the nip in the process direction. Increasing the flare angle at the inboard and outboard ends of the fuser nip will only introduce anti-wrinkle wrinkle, or wrinkle in the other direction, in sheets which would not normally wrinkle at all, so this is not a feasible solution to the problem.

Figure 2:
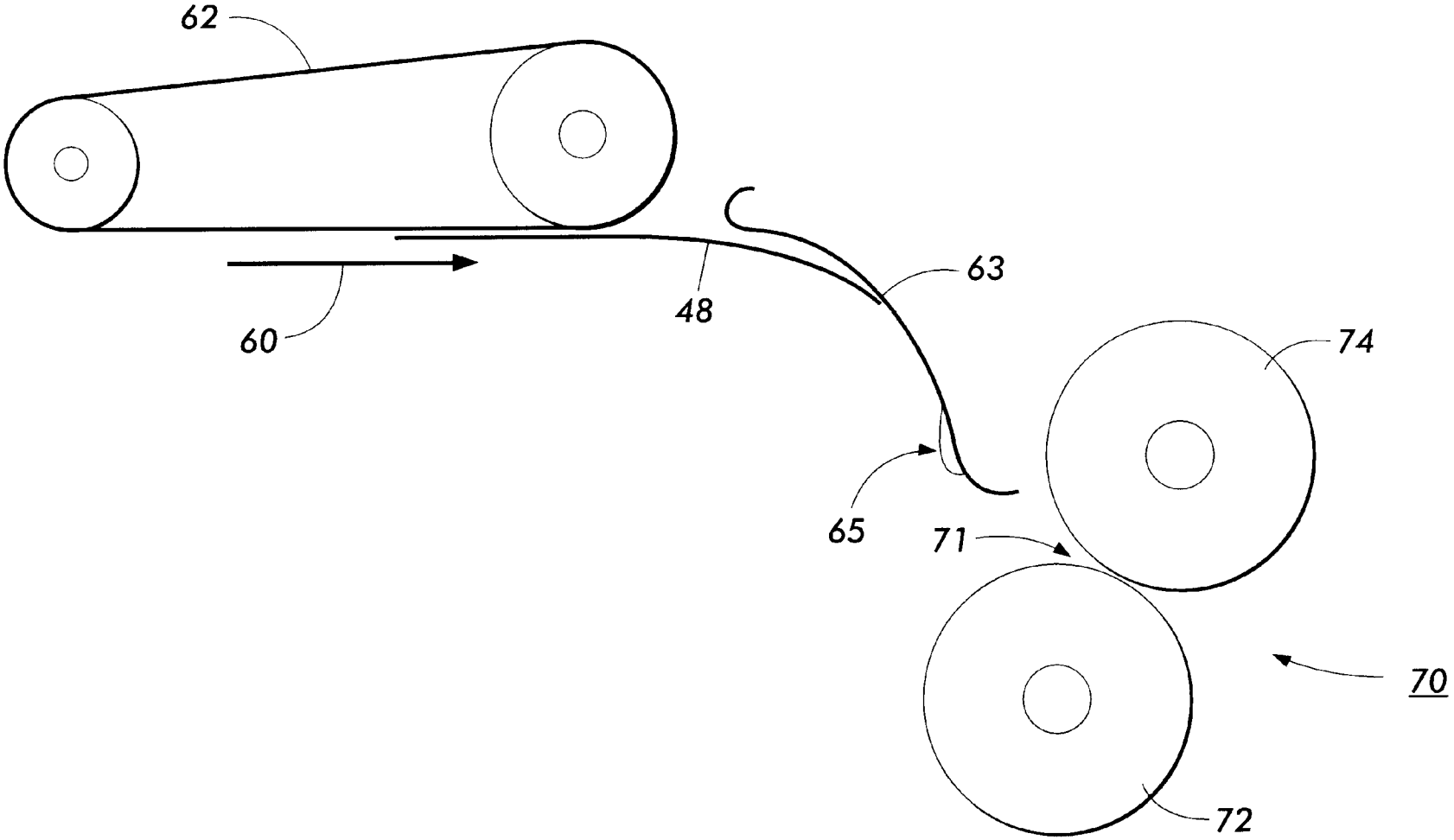
FIG. 2 is a detailed side view of the sheet path from the prefuser transport to the fuser assembly.

The solution is to purposely add a "saddle" 65, FIG. 2, in the center portion of the inlet baffle 63 on the baffle surface which last contacts and controls the sheet 48 before entry into the fuser nip. The saddle 65 removes most of the corrugation along approximately 90 to 95% of the centermost portion of the sheet. Any remaining corrugation at the inboard and outboard ends is removed by virtue of the fuser flare. Removing sheet wrinkle also markedly reduces the related problems of "watermarks" as well as image quality distortion which occurs when the dimensions of the sheet itself undergo assymetric stretching and then fusing. Although subtle, the effectivity of this center saddle is very real.

Figure 3:
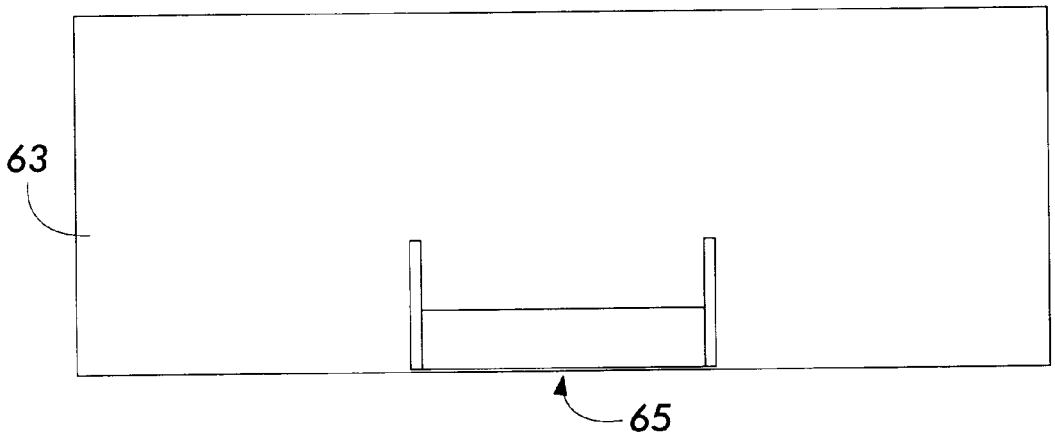
FIG. 3 is an end view in the direction of arrow 60 in FIG. 2 of the baffle arrangement of the present invention.
Figure 4:
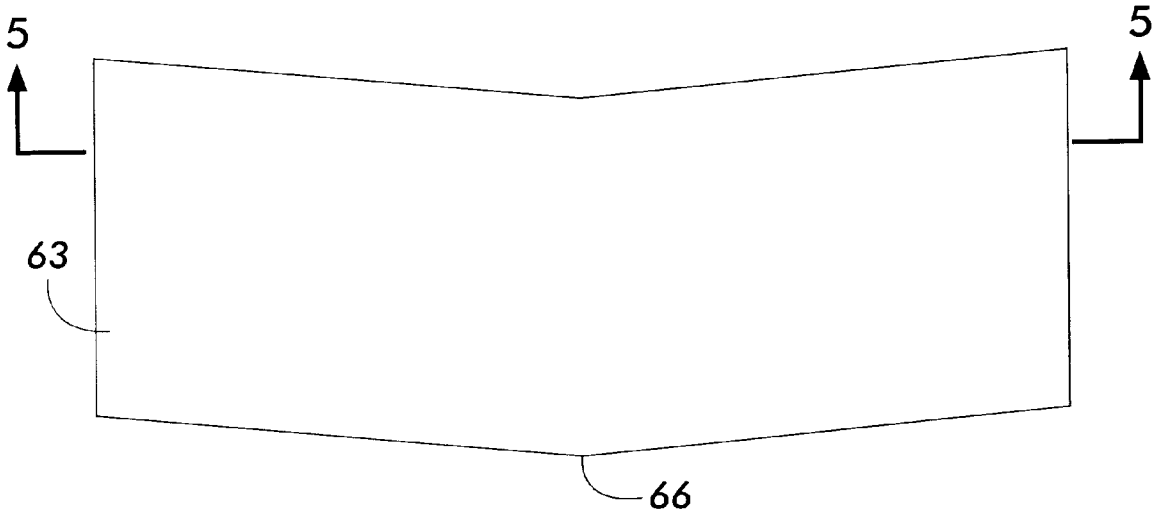
FIG. 4 is an end view in the direction of arrow 60 in FIG. 2 of a second embodiment of the baffle arrangement of the present invention.
Figure 5:
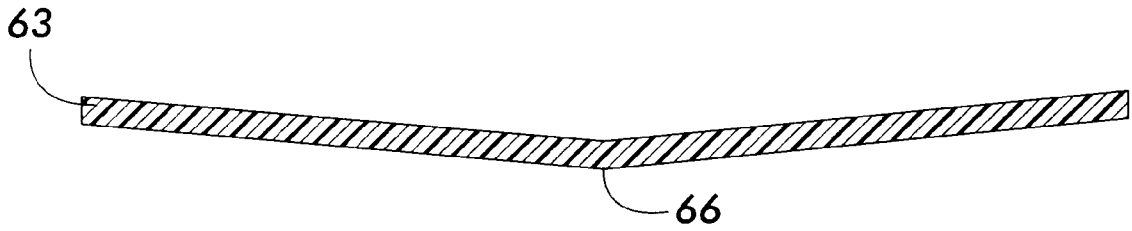
FIG. 5 is a sectional view taken along line A—A of FIG. 4.

Turning next to FIG. 2, a detailed illustration of the sheet path from the prefuser transport 62 to the fuser assembly 70 is shown. As the sheet 48 contacts the baffle 63 it is directed toward the fuser nip 71. The protrusion or saddle formed into the center of the baffle (seen in FIG. 3) removes any corrugation in the sheet and causes the sheet to enter nip 71 in a substantially smooth and flat condition. This allows the flare of the fuser to remove any remaining corrugation in the sheet as it is fused. FIGS. 4 and 5 illustrates an alternative embodiment in which the baffle 63 has a "v-shaped" profile which again removes substantially all of the corrugation in a sheet prior to fusing. The performance improvement realized by these baffles allows smaller nip flares to be used to achieve the same wrinkle performance compared to flat baffles. This in turn gives wider latitude to the onset of anti-wrinkle.

The saddle can be an additional piece properly attached and smoothed, or a specific shape formed right into the baffle. The advantage of an attached piece is that it can be installed later as a retrofit, particularly for those markets using lighterweight papers or allows the baffle to be adjusted to remove the necessary amount of corrugation for a particular application.

While the invention herein has been described in the context of heat and pressure fusing device, it will be readily apparent that the device can be utilized in any fusing device in which high localized pressure is applied to a sheet to fix an image thereon.

In recapitulation, there is provided a fuser baffle which helps to minimize or eliminate sheet wrinkle by a fuser. A small "saddle" is added to the center section of the inlet to the fuser on the baffle surface which last contacts and controls the sheet before entry into the fuser nip. The saddle removes most of the corrugation along approximately 90 to 95% of the centermost portion of the sheet. Any remaining corrugation at the inboard and outboard ends is removed by virtue of the fuser flare.

It is, therefore, apparent that there has been provided in accordance with the present invention, an anti-wrinkle device for a fuser baffle that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. A printing machine in which an image on a sheet is pressure fused to the sheet, comprising:

a marking engine to place a toner image on a sheet;

a pressure fusing device;

a drive for transporting the sheet having an unfused image thereon to said pressure fusing device; and a baffle located between said drive and said pressure fusing device, said baffle having a substantially V-shape protrusion formed therein to remove wrinkle from the sheet prior to fusing wherein said protrusion contacts the sheet at substantially a center of the sheet so that any corrugations remaining in the sheet are directed to lateral edges of the sheet.

2. A printing machine according to claim 1, wherein said protrusion contacts the sheet on the side of the sheet opposite the unfused image.

3. A printing machine according to claim 1, wherein said pressure fusing device further includes a heated member to fix an image to a sheet.

4. A printing machine according to claim 1, wherein said protrusion is formed in said baffle at least at a point of the baffle that last contacts the sheet before the sheet enters said pressure fusing device.

5. A printing machine in which an image on a sheet is pressure fused to the sheet, comprising:

a marking engine to place a toner image on a sheet;

a pressure fusing device;

a drive for transporting the sheet having an unfused image thereon to said pressure fusing device; and a baffle located between said drive and said pressure fusing device, said baffle having a substantially V-shaped profile to remove wrinkle from the sheet prior to fusing wherein said substantially V-shaped profile has an apex contacting the sheet at substantially a center of the sheet so that any corrugations remaining in the sheet are directed to lateral edges of the sheet.

6. A printing machine according to claim 5, wherein said baffle has said substantially V-shaped profile at least at a point of the baffle that last contacts the sheet before the sheet enters said pressure fusing device.

7. A printing machine according to claim 5, wherein said apex contacts the sheet on the side of the sheet opposite the unfused image.

8. A printing machine according to claim 5, wherein said pressure fusing device further includes a heated member to fix an image to a sheet.

* * * * *